US010677556B2

(12) United States Patent
Rambo et al.

(10) Patent No.: US 10,677,556 B2
(45) Date of Patent: Jun. 9, 2020

(54) CLEANING IMPLEMENT FOR FIREARM

(71) Applicant: Bore Tech, Inc., Quakertown, PA (US)

(72) Inventors: Jesse E. Rambo, Springtown, PA (US); Zachary A Rambo, Sellersville, PA (US)

(73) Assignee: Bore Tech, Inc., Quakertown, PA (US)

( * ) Notice: Subject to any disclaimer, the term of this patent is extended or adjusted under 35 U.S.C. 154(b) by 477 days.

(21) Appl. No.: 15/442,889

(22) Filed: Feb. 27, 2017

(65) Prior Publication Data

US 2017/0254611 A1 Sep. 7, 2017

Related U.S. Application Data

(60) Provisional application No. 62/301,766, filed on Mar. 1, 2016.

(51) Int. Cl.
*F41A 29/00* (2006.01)
*F41A 29/02* (2006.01)

(52) U.S. Cl.
CPC ..... *F41A 29/02* (2013.01); *F41A 29/00* (2013.01)

(58) Field of Classification Search
CPC ..... F41A 29/00; F41A 29/02
See application file for complete search history.

(56) References Cited

U.S. PATENT DOCUMENTS 1,532,222 A * 4/1925 Belding ..... F41A 29/02 15/104.16
1,786,520 A * 12/1930 Darling ..... F41A 29/02 15/104.19
1,927,747 A * 9/1933 Justice ..... B08B 9/0436 15/183
2,146,363 A * 2/1939 Leeman ..... E21B 37/02 15/104.16
3,710,411 A * 1/1973 Murguiondo ..... F41A 29/02 15/104.16
D562,935 S 2/2008 Morgan
7,644,463 B1 * 1/2010 Crawford ..... B08B 9/04 15/104.001
9,995,555 B2 * 6/2018 Rohlin ..... F41A 29/02
2006/0243303 A1 * 11/2006 Harr ..... B08B 9/043 134/6
2013/0091753 A1 * 4/2013 Rogers ..... F41A 29/02 42/95
2013/0269234 A1 * 10/2013 Williams ..... F41A 29/02 42/95
2014/0123416 A1 * 5/2014 Klemm ..... F16L 55/48 15/104.05
2015/0313681 A1 * 11/2015 Eikens ..... A61B 1/122 15/104.05
2016/0069158 A1 * 3/2016 Coyle, Jr. ..... E21B 37/02 15/104.05

* cited by examiner

*Primary Examiner* — Michael D Jennings
(74) *Attorney, Agent, or Firm* — Howson & Howson LLP

(57) ABSTRACT

A cleaning implement for a firearm comprises a rigid, axially extending, support adapted for connection to the end of a cleaning rod or other manipulating implement. Axially spaced, resilient panels are integrally molded onto a hub through which the support extends. A barb at an end of the support is provided to secure a cleaning patch that is wrapped around the outer edges of the panels and maintained in contact with an interior surface of the firearm during cleaning by the resilience of the panels.

4 Claims, 8 Drawing Sheets

CLEANING IMPLEMENT FOR FIREARM

CROSS REFERENCE TO RELATED APPLICATION

This application claims priority on the basis of provisional patent application 62/301,766, filed Mar. 1, 2016, the disclosure of which is here incorporated by reference.

FIELD OF THE INVENTION

This invention relates generally to firearms and more particularly to improvements in cleaning implements for removal of propellant residues, metal deposits, oil, grease and other debris from the interior surfaces of barrel extensions, locking lug recesses, upper receivers, bolt carriers, actions, and other passages in a firing mechanism.

BACKGROUND OF THE INVENTION

The bore of a firearm is typically cleaned by using a brush provided on the end of an elongated rod to remove coarse deposits. Brushing is followed by using a cleaning patch, which can be made from a variety of materials such as woven or non-woven fabrics of natural or synthetic fibers, other fibrous materials, or synthetic sheet materials. The patch is typically inserted through a slot formed adjacent the end of an elongated cleaning rod, and soaked in a liquid mixture composed of organic solvents and lubricants. Other cleaning methods utilize special cleaning patch supporting devices. For example, in the universal patch assembly described in United States Patent Publication No. 2013/0269234, published on Oct. 17, 2013, resilient arms maintain the patch in close contact with the bore.

Cleaning a rifle bore, and even the chamber, is a straightforward process. However, the barrel extension or locking lug recess, i.e., the space immediately behind the chamber that receives locking lugs on the end of the bolt, presents problems. Cleaning the barrel extension in a rifle such as the AR10 or AR15 is difficult because the multiple, inwardly protruding, bolt-retention lugs restrict in the opening into which the bolt moves. A similar problem exists in the case of a bolt-action rifle, where the locking lug recess in the action typically has two or three inwardly-protruding lug-retaining walls. In both cases, the inwardly protruding parts make it difficult to introduce a cleaning device that is capable of maintaining pressure against the wall of the barrel extension or the locking lug recess.

One approach to the problem of cleaning barrel extensions has been to use a star-shaped cleaner such as the one depicted in U.S. Design Pat. No. D562,935, granted on Feb. 26, 2008. The cleaner is typically composed of felt, and the points of the star are shaped to pass through the gaps between the bolt-retention teeth of the rifle. However, there remains a need for a cleaning implement that can be utilized with an ordinary cleaning patch, that can enter an internal space through a restricted opening, and that can reliably maintain pressure between the patch and the interior surface of a barrel extension, upper receiver, bolt carrier, locking lug recess, action, or other passage in the firing mechanism of a firearm.

SUMMARY OF THE INVENTION

The cleaning implement in accordance with the invention comprises a rigid support extending along an axis and having front and rear ends. One or more resilient panels, and preferably at least two axially spaced resilient panels, are secured to the rigid support. Each panel extends radially outward from the rigid support and has a front surface and a rear surface facing in opposite directions along the axis of the support. Each panel also has an outer edge extending from its front surface to its rear surface. A connector at the rear end of the rigid support is provided to secure the implement to an elongated manipulating element, typically a rod aligned with the axis of the rigid support, and a patch retaining means, for example a barb at the front end of the rigid support, is provided for securing a patch to the cleaning implement, so that the patch is maintained in contact with the outer edge of each resilient panel while the implement is moved back and forth, or rotated, within a passage in a firearm.

The sizes of the panels can be such that portions of their outer edges are resiliently deformed when the implement is in the passage to be cleaned. The deformation of those portions of the outer edges of the panels causes a compressive force to be exerted on the patch, maintaining it in close contact with the wall of the passage. A cleaning implement with two or more axially spaced panels can maintain contact between the patch and the surface being cleaned over a relatively large area while still maintaining sufficient resilience to enable the implement and the patch to pass beyond inwardly protruding bolt-retention lugs or walls and through other restrictions.

In the case of cleaning implement for the upper receiver of an AR rifle, the outer edges of the panels are preferably circular.

In the case of a cleaning implement for the barrel extension of an AR rifle, each panel is preferably in the shape of a symmetrical cross in axial projection.

In the case of a cleaning implement for the locking lug recess of a bolt action rifle having a bolt with two lugs, the outer edge of each panel is preferably in a "bow-tie" shape and comprises a first pair of convex arcs, having a first radius, on opposite sides of the axis, and a second pair of convex arcs, having a radius greater than the first radius, on opposite sides of the axis. The arcs of the first pair are symmetrical with respect to a first imaginary axial plane and the arcs of the second pair are symmetrical with respect to a second imaginary axial plane perpendicular to the first imaginary axial plane. In a preferred embodiment of the cleaning implement for a bolt action rifle, the arcs of the second pair of arcs of each resilient panel are constituted by outer edges of oppositely extending tabs formed as parts of the resilient panel.

In the case of a bolt-action rifle having a bolt with inwardly protruding lug-retention elements in its locking lug recess, the panel is configured with three tabs protruding from a central hub at angles spaced by 120°. The outer edges of the tabs and the edges of the panel extending from each tab to the adjacent tabs are preferably in the shape of convex arcs.

In all embodiments having plural, axially spaced, resilient panels, the panels are preferably connected by a hub surrounding the rigid support, and hub and the two panels are composed of the same resilient material and molded as a unit. The rigid support extends into, and preferably through, the hub. In an embodiment having a single panel, the single panel is also preferably molded as a unit with a hub.

DETAILED DESCRIPTION

Figure 1:
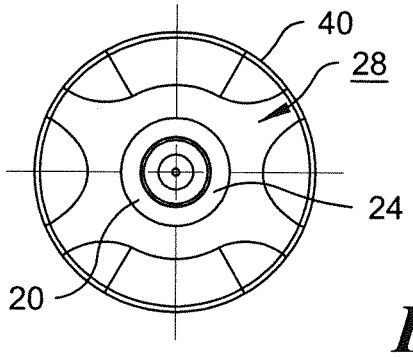
FIG. 1 is a front elevational view of a cleaning implement for the upper receiver of a firearm.
Figure 2:
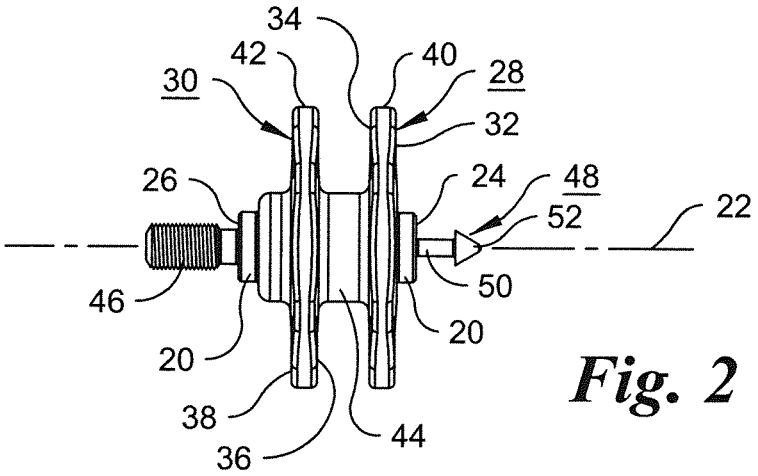
FIG. 2 is a side elevational view of the cleaning implement of FIG. 1.
Figure 3:
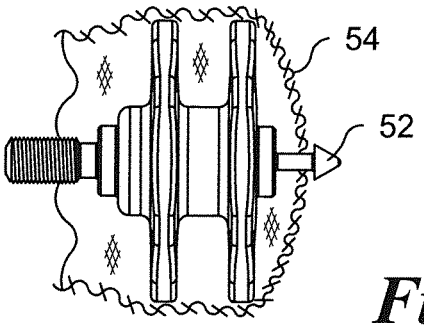
FIG. 3 is a side elevational view of the cleaning implement of FIG. 1, showing an attached patch in cross-section.

FIGS. 1-3 depict a cleaning implement for the upper receiver of an AR rifle, which can be automatic, semi-automatic or single-shot. The implement comprises a rigid support 20, preferably composed of aluminum. The support 20 extends along an axis 22, and has a front end 24 and a rear end 26. The support can be in the form of a cylinder having an annular groove (not shown) at an intermediate location between its ends for retaining a hub composed of a molded resilient material. The cylinder serves as a support for axially spaced resilient panels 28 and 30. Each panel extends radially outward from the support 20. Panel 28 has a front surface 32 facing forward in the axial direction and a rear surface 34 facing in the opposite direction. Panel 30 similarly has a front surface 36 and a rear surface 38. Panel 28 has a circular outer edge 40 that extends from its front surface 32 to its rear surface 34, and panel 30 has a similar outer edge 42.

The panels can be made from any of a large variety of resilient elastomeric materials, but are preferably composed of a nitrile rubber having a medium soft durometer value of 50 A, which enables them to exert a sufficient force to press a patch against the inner wall of the upper receiver and to grip the patch effectively.

The panels are integrally molded as a unit with a cylindrical hub 44 through which the support 20 extends. Preferably the cleaning implement and support are insert molded ("overmolded"), the support being in place in the mold when the elastomeric material is introduced into the mold, so that the completed cleaning implement can be taken out of the mold when the elastomeric material is cooled and solidified.

Before molding, the support is coated with a conventional heat-activated primer that causes the elastomeric material to bond to the support in the molding process.

As shown in FIG. 2, the circular outer edges 40 and 42 of the panels are beveled where they meet the front and rear faces of the panels, and are shaped with a repeating series of widening and narrowing parts, which impart desired flexing properties to the panels while enabling the panels to grip a patch more effectively.

An externally threaded connector 46 at the rear end of the support 20 is provided to secure the implement to an elongated manipulating element used to push, pull and rotate the cleaning implement. The elongated element can take any of several forms. For example, it can be a rigid or flexible metal rod, or a flexible cable. In the case of a rigid cleaning rod, the rod, when connected, is aligned with the axis 22 of the rigid support. The connector 46 is preferably unitary with the support 20. The connector does not need to have external threads, however. It can have any of a variety of different configurations. For example, it can be internally threaded, or it can utilize a set screw or other clamping device, or a connecting pin, to secure the cleaning implement to the cleaning rod. It is also possible to connect the cleaning implement permanently to the cleaning rod. In such a case, the panel-support can be unitary with the cleaning rod. Thus the means at the rear end of the rigid support for securing the cleaning implement to the elongated cleaning rod can be either a temporary or a permanent connection.

A barb is provided at the front end of the support 20. The barb comprises a short cylindrical rod 50 extending along axis 22 from the front end 24 of the support 20 and a conical point 52 at the front end of the rod. The diameter of the base of the conical point 52, which meets the front end of the rod 50, is greater than the diameter of the rod. Consequently, when the point 52 penetrates a cleaning patch 54, as shown in FIG. 3, the cleaning patch can be reliably secured to the cleaning implement. As shown in FIG. 3, the patch, which can be supplied as a flat patch having a circular, rectangular, or other shape, can be folded over the two resilient circular panels 28 and 30, and maintained in contact with the outer edges of both of the resilient panels while the implement is moved into a passage in a firearm.

Figure 4:
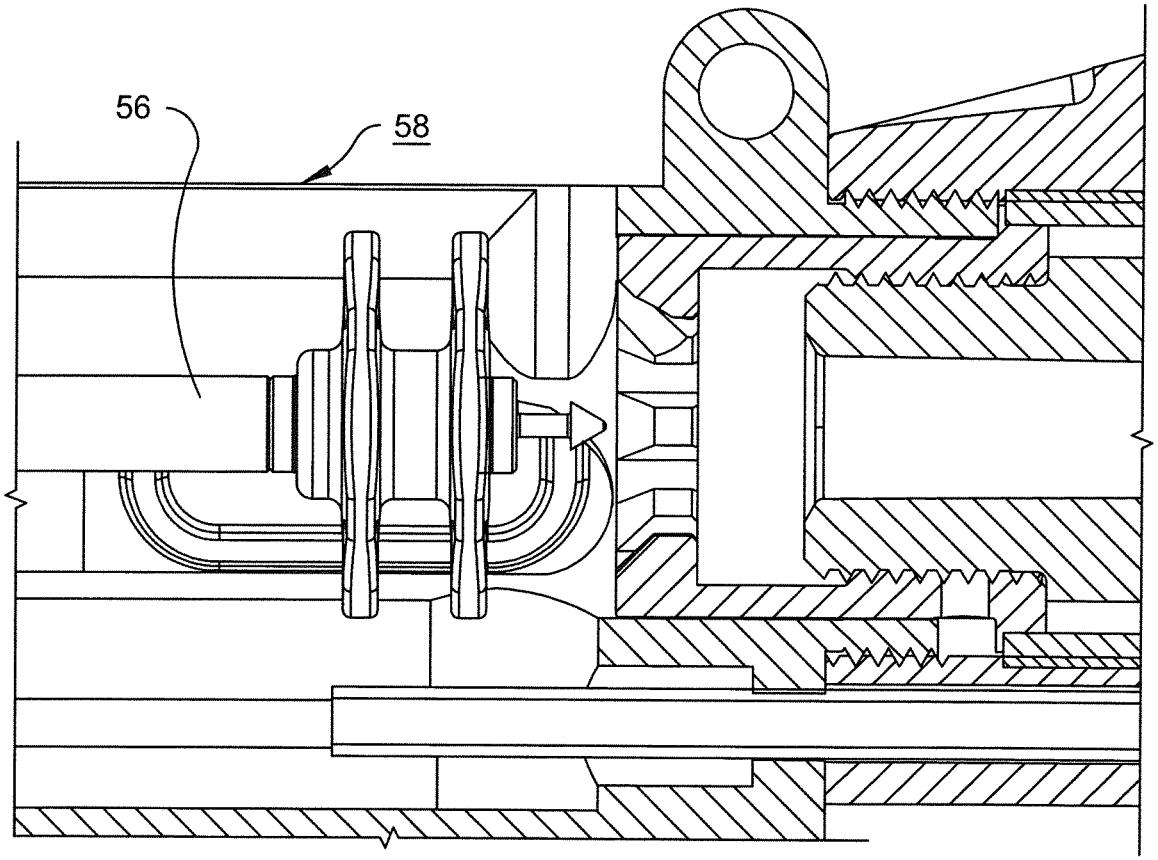
FIG. 4 is a longitudinal sectional view showing the relationship between the cleaning implement of FIGS. 1-3 and the upper receiver of an AR rifle.

FIG. 4 shows the cleaning implement of FIGS. 1-3 secured to the distal end of a cleaning rod 56 and disposed inside the upper receiver 58 of an AR rifle. The patch is not shown in FIG. 4, but will be present as depicted in FIG. 3 when the upper receiver is being cleaned. The sizes of the panels are preferably such that, when they fit the upper receiver, the outer edges of the panels are deformed. Consequently the patch will be maintained in close contact with the inner wall of the upper receiver by the force exerted by the resilience of the panels.

The two axially spaced panels maintain contact between the patch and the surface being cleaned over a relatively large area, but afford the implement sufficient resilience to enable the implement and the patch to pass over irregular features on the upper receiver wall.

Although the size of the panels is preferably such that they bend or compress when in use, and their resilience exerts a force pressing the patch material against the surface being cleaned, the degree of bending or compression can be very small and even negligible in the case where a relatively thick cleaning patch is utilized. In that case the resilience of the patch itself can maintain contact between the outer parts of the patch and the surface being cleaned.

Figure 5:
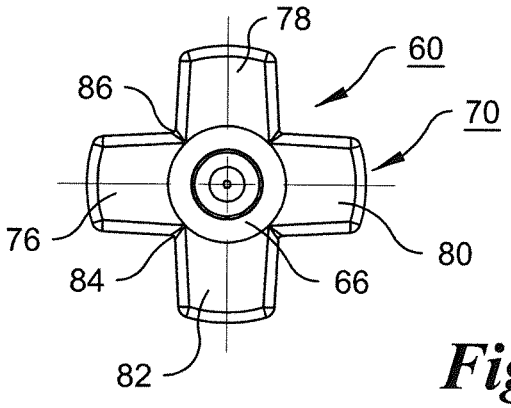
FIG. 5 is a front elevational view of a cleaning implement for the barrel extension of an AR rifle.
Figure 6:
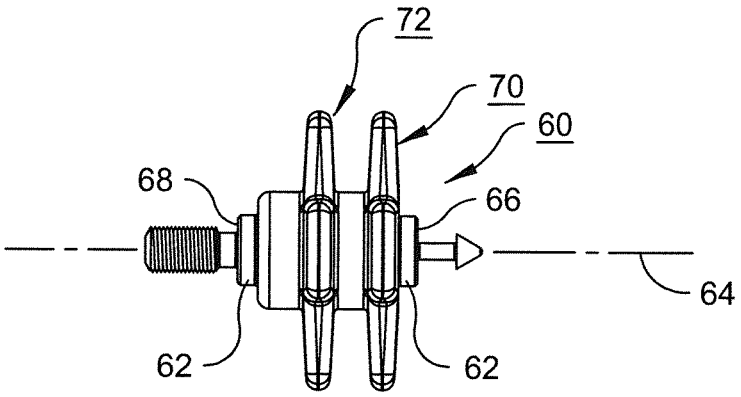
FIG. 6 is a side elevational view of the cleaning implement of FIG. 5.

FIGS. 5 and 6 show an embodiment of the cleaning implement adapted for use in cleaning the barrel extension of an AR rifle. In this embodiment, each of the two panels is in the shape of a symmetrical cross in axial projection.

The cleaning implement 60 is similar to the cleaning implement shown in FIGS. 1-3 except that the panels are not circular in axial projection, but instead the outer edges of the panels are configured so that each of the panels, in axial projection is in the shape of a symmetrical cross.

The rigid support in this embodiment is identical to the rigid support in the embodiment of FIGS. 1-4. The support is a rigid circular cylinder 62, preferably composed of aluminum, and having an annular groove (not shown) at an intermediate location between its ends. The support 62 extends along, and is symmetrical about, an axis 64, and has a front end 66 and a rear end 68. The support 62 serves as a support for axially spaced resilient panels 70 and 72, which are identical. Each panel extends radially outward from the support 62, and has front and back surfaces and an outer edge that extends from its front surface to its rear surface. As in the implement in FIGS. 1-4, the panels are molded as a unit with a hub 74, through which the support 62 extends.

The support is provided with a barb and a connecting part similar to the barb and connector of the cleaning implement of FIGS. 1-4.

Figure 7:
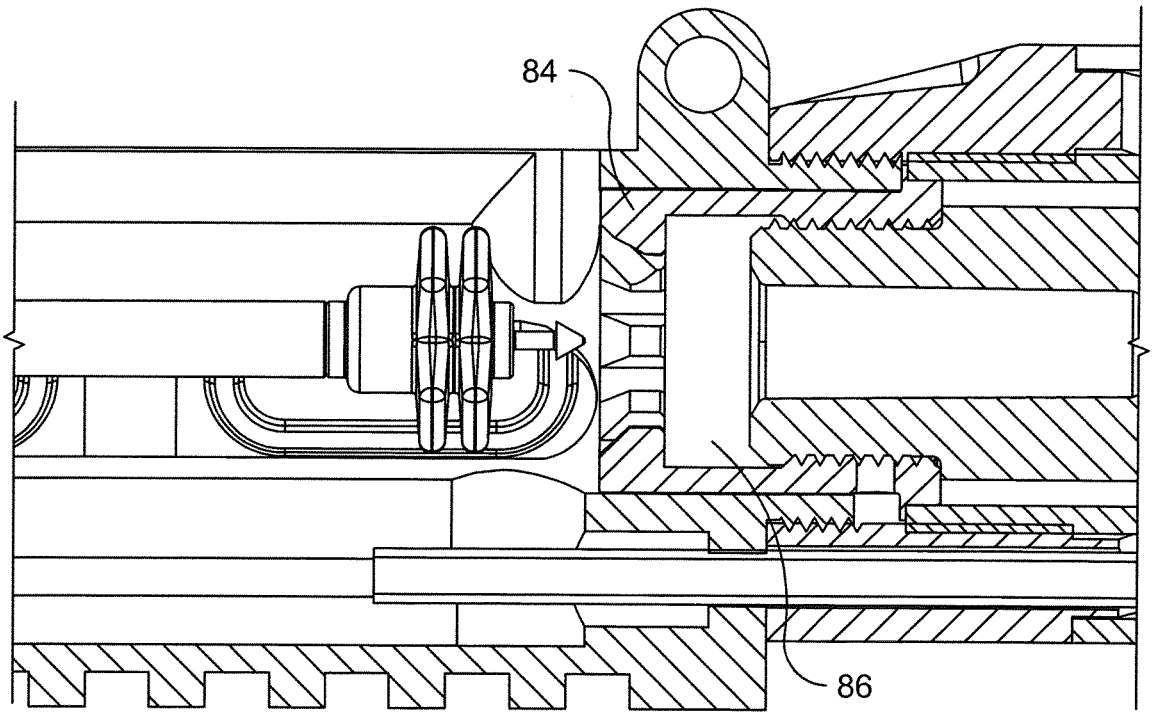
FIG. 7 is a longitudinal sectional view showing the relationship between the cleaning implement of FIGS. 5 and 6 and the barrel extension of an AR rifle as the cleaning implement is being inserted through the upper receiver of the rifle.
Figure 8:
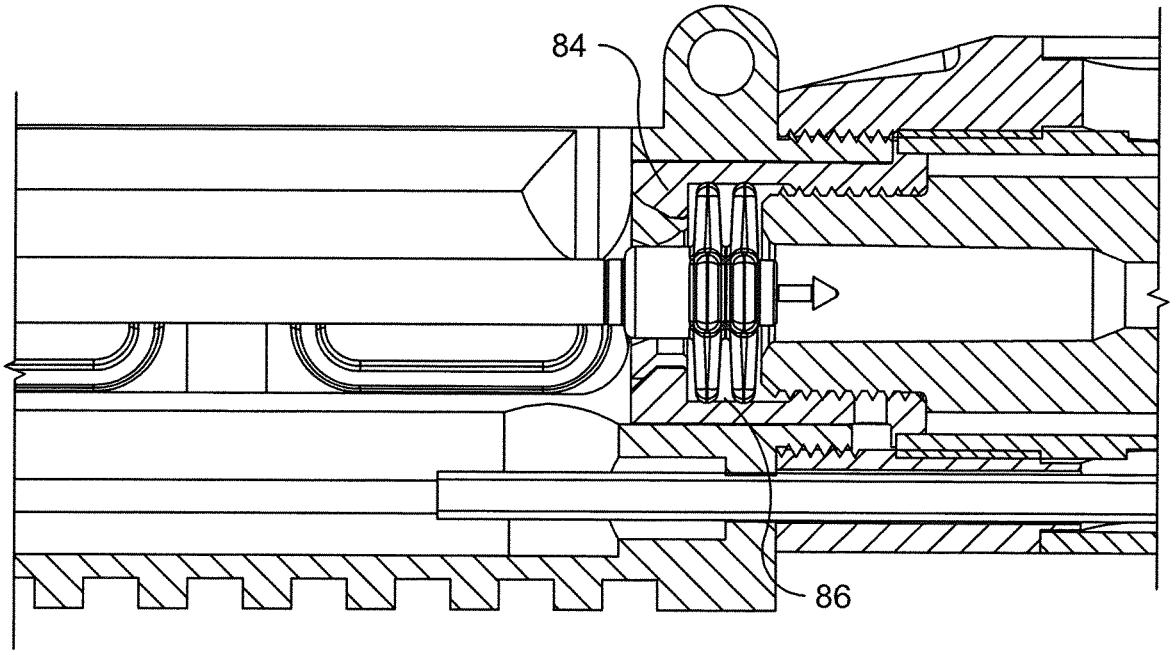
FIG. 8 is a longitudinal sectional view showing the relationship between the cleaning implement of FIGS. 5 and 6 and the barrel extension of an AR rifle when the cleaning implement is in the upper receiver.
Figure 9:
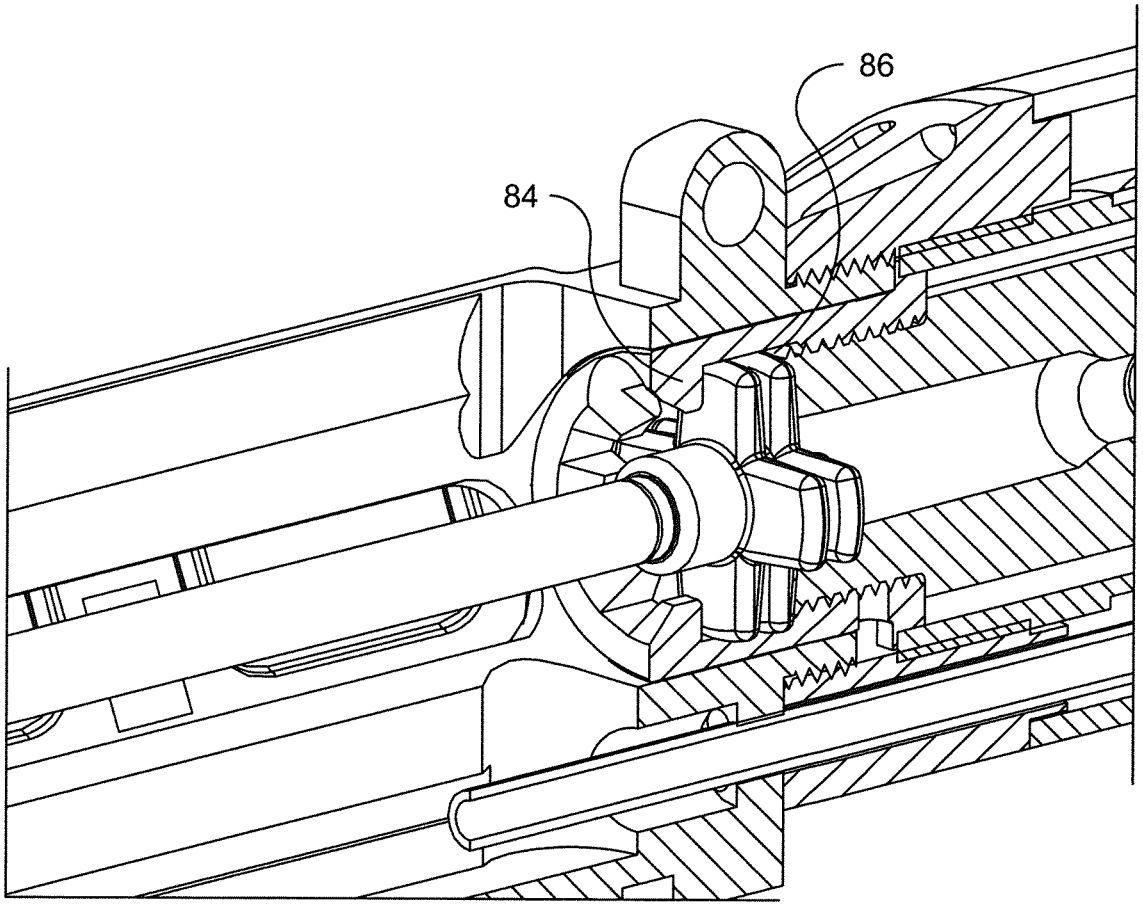
FIG. 9 is a cut-away perspective view also showing the relationship between the cleaning implement of FIGS. 5 and 6 and the barrel extension.

As shown in FIG. 5, the front panel 70 of cleaning implement 60 is in the form of a symmetrical cross composed of four identical tabs 76, 78, 80 and 82, each approximately in the shape of a rectangle, but having an arc-shaped outer end. The arc-shaped ends of the tabs are preferably disposed in a common imaginary circle. The four tabs extend radially outward, and each tab extends in a direction 90° apart from the directions of each of the two adjacent tabs. The rear panel 72 has a shape identical to that of the front panel Each of these tabs meets its adjacent tab at a corner, e.g., corners 84 and 86, located a short distance radially outward from the hub 72. The four tabs 76-82 can therefore flex independently, and hereby allow the cleaning implement, with a patch (not shown) secured to its barb and wrapped around the outer parts of its panels, to pass through the space between the bolt-retaining lugs 84 and into the barrel extension 86 of a rifle, as shown in FIGS. 7-9.

As in the case of the upper receiver cleaning implement in FIGS. 1-4, the panels and hub of the cleaning implement of FIGS. 5-9 can be made from any of a large variety of resilient elastomeric materials, but are preferably composed of a nitrile rubber having a medium soft durometer value of 50 A, which enables them to exert a sufficient force to press the patch against the inner wall of the barrel extension and to grip the patch effectively. Here, as in the case of the cleaning implement of FIGS. 1-4, the deformation of the panels that takes place when the implement is in the space to be cleaned (in this case the barrel extension) can be small, and even negligible, if a thick cleaning patch is utilized.

Figure 10:
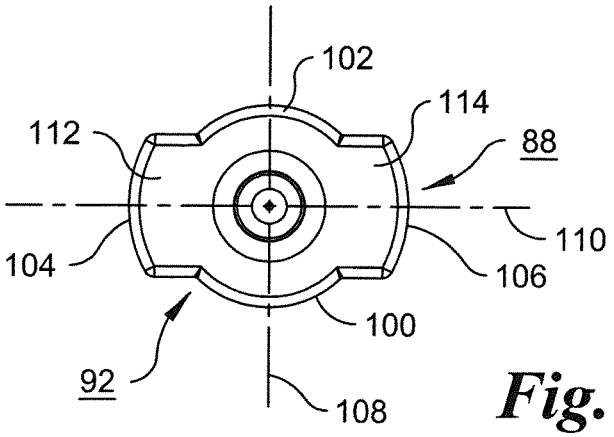
FIG. 10 is a front elevational view of a cleaning implement for a bolt action rifle.
Figure 11:
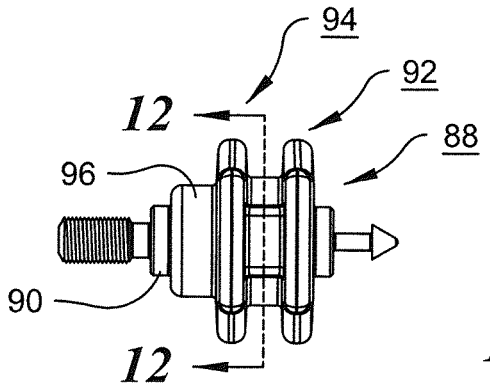
FIG. 11 is a side elevational view of the cleaning implement of FIG. 10.
Figure 12:
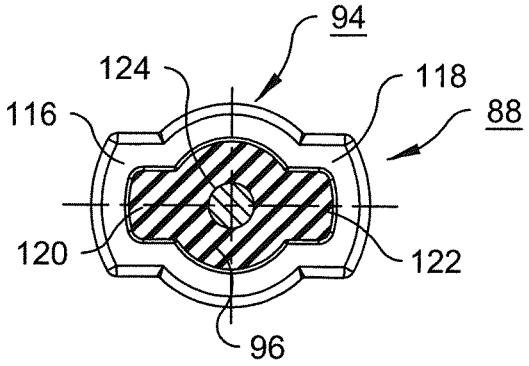
FIG. 12 is a cross-sectional view of the cleaning implement of FIGS. 10 and 11, taken on section plane 12-12 in FIG. 11.

The cleaning implement 88, shown in FIGS. 10-12 is designed for cleaning the locking lug recess in the action of a bolt action rifle. The locking lug recess is typically provided with two opposed slots through which locking lugs protruding radially from the bolt of the rifle can pass axially as the chamber is being loaded, or a spent cartridge is being ejected.

Cleaning implement 88 is similar to the previously described implements except for its panel and hub configuration. It comprises a rigid support 90 which can be identical to the supports 20 and 62 in the previously described embodiments. The support is provided with a barb at a forward end and a connector at the opposite end. Axially spaced "bow-tie" shaped panels 92 and 94 are provided on a hub 96 through which the support 90 extends. The bow-tie shaped panels correspond to the bow-tie shaped slots through which the retention lugs of the bolt pass.

Figure 13:
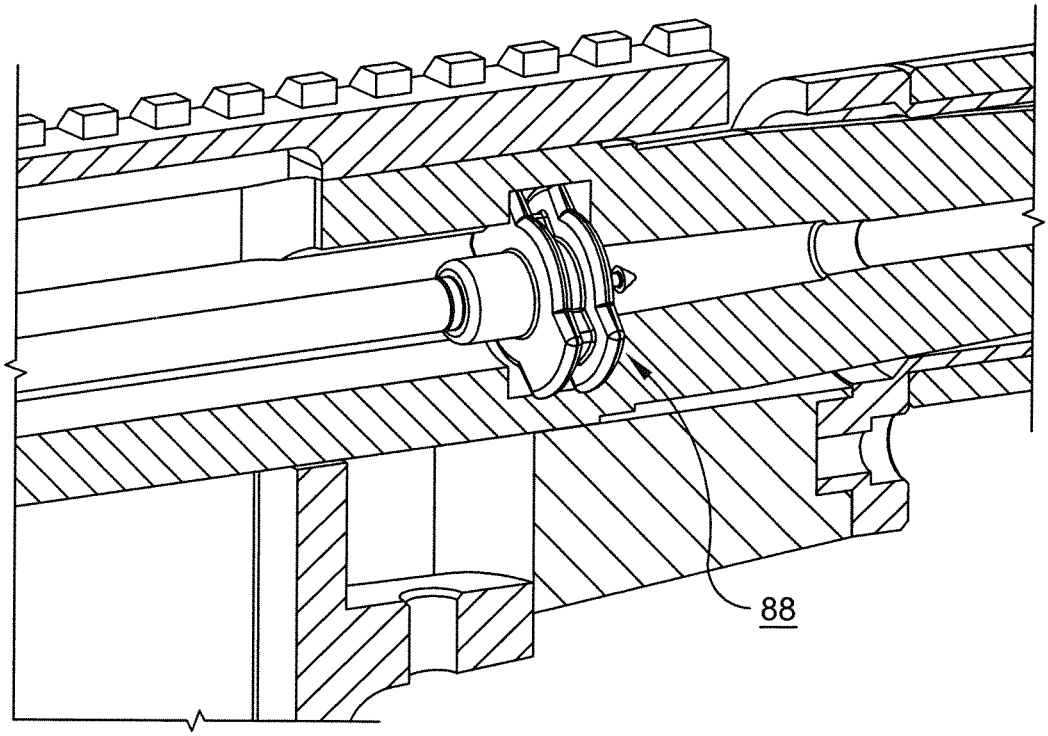
FIG. 13 is a cut-away perspective view showing the relationship between the cleaning implement of FIGS. 10, 11 and 12 and the locking lug recess of a barreled action on a bolt action rifle.

As shown in FIG. 10, the outer edge 98 of each said panel comprises a first pair of convex arcs 100 and 102 on opposite sides of the axis of the support, and a second pair of convex arcs 104 and 106, also on opposite sides of the axis. Arcs 100 and 102 are disposed in an imaginary common circle and arcs 104 and 106 are likewise disposed in an imaginary common circle. The arcs 104 and 106 have a radius greater than said than the radius of arcs 100 and 102. Arcs 100 and 102 are symmetrical with respect to a first imaginary axial plane 108, and arcs 104 and 106 are symmetrical with respect to a second imaginary axial plane 110, which is perpendicular axial plane 108. The convex arcs 104 and 106 are at the outer edges of oppositely extending tabs 112 and 114 respectively, and are preferably shaped so that they bend slightly when the cleaning implement, with a patch wrapped around them is in the locking lug recess in the action of a bolt action rifle as shown in FIG. 13. Here again, if a thick patch is utilized, the bending of the tabs that takes place while the locking lug recess is being cleaned can be small and even negligible.

As shown in FIG. 12, the rear panel 94 has a shape identical to that of front panel 92, and is formed with oppositely extending tabs 116 and 118. When the cleaning implement is being inserted into the locking lug recess, the tabs 112 and 116 pass through one of two opposed slots though which the locking lugs of the bolt move, and tabs 114 and 118 pass through the other of the two opposed slots. FIG. 13 shows the cleaning implement 88 of FIGS. 10-12 being rotated while in the locking lug recess of a bolt action rifle.

In this embodiment, as in the previously described embodiments, the panels 92 and 94 are molded as a unit with the hub 96. As shown in FIG. 12, the part of the hub 90 between the two panels is formed with opposite extensions 120 and 122. Extension 120 provides support to tabs 112 and 116 and extension 122 provides support to tabs 114 and 118. FIG. 12 also shows the narrow part 124 of the support 90 at the bottom of an annular retaining groove at an intermediate location between the ends of the support. Here as in the other embodiments, the resilient material of the hub and the panels is molded as a unit onto the support and held against axial movement on the support by engagement of the resilient material with the radial walls of the retaining groove.

A similar cleaning implement (not shown), with panels each having three tabs disposed at 120° intervals about the support axis, can be utilized in the case of a bolt-action rifle having a bolt with three correspondingly spaced lugs and a locking lug recess with three inwardly protruding walls.

The embodiments described above illustrate three of numerous possible modifications of a firearm cleaning implement in accordance with the invention, wherein resilient panels are provided on a support having a connector for attachment to a cleaning rod or other manipulating element, and a feature for holding a patch in place while folded over outer edges of the panels. Many modifications can be made to the cleaning implement, depending on the size and type of the firearm passage for which it is intended. For example, although the use of two axially spaced panels is preferred for use with most rifles, it is possible to take advantage of certain aspects of the invention using a cleaning implement having only a single resilient panel, but with a barb or other attachment device for securing a patch to implement so that the patch can be folded over the outer edge portions of the panel. In the case of a single panel, or in the case of plural panels not integrally connected by a hub, the panels can be formed by a process such as stamping instead of being molded. The panels of the single-panel implement can be formed in any of the shapes depicted in FIGS. 1, 5 and 10, or in various other shapes. In other variations, it is possible to utilize three or more axially spaced resilient panels, and also to incorporate a plug into the cleaning implement.

Although the support, i.e., support 20 in FIG. 2, is preferably in the form of a circular cylinder with an annular groove at an intermediate location between its ends, the support can take other forms. For example, it can be formed with a non-circular transverse cross-section, or even provided with slots. The non-circular cross-section can help resist rotation of the elastomeric parts relative to the support. However, if the elastomer is properly bonded to the support, a non-circular cross-sectional shape has been found unnecessary at least in cleaning implements of a size suitable for smaller firearms such as the AR-10 and AR-15.

Finally, it is possible to utilize panels having various other shapes and sizes, depending on the type of firearm with which the cleaning implement is to be used. The shape of the hub can also be varied. For example, tab-supporting extensions similar to extensions 120 and 122 in FIG. 12 can be formed on any of a variety of hubs.

What is claimed is:

1. A cleaning implement for a firearm, the cleaning implement comprising:

rigid support extending along an axis and having front and rear ends;

a plurality of axially spaced elastomeric panels secured to said rigid support, each of said elastomeric panels being resilient and flexible, having a rigidity less than that of said rigid support, extending radially outward from said rigid support, and having a front surface and a rear surface facing in opposite directions along said axis, and each said panel also having an outer edge extending from its front surface to its rear surface;

means at said rear end of the rigid support for securing said implement to an elongated manipulating element, and means for securing a cleaning patch to the cleaning implement, whereby said cleaning patch can be maintained in contact with the outer edge of each of said elastomeric panels while the implement is moved into a passage in a firearm; wherein the outer edge of each said panel comprises a first pair of convex arcs on opposite sides of said axis, said arcs of the first pair having a first radius, and a second pair of convex arcs on opposite sides of said axis said arcs of the second pair having a second radius greater than said first radius, said first pair of arcs being symmetrical with respect to a first imaginary axial plane and said second pair of arcs being symmetrical with respect to a second imaginary axial plane perpendicular to said first imaginary axial plane.

2. The cleaning implement according to claim 1, wherein the arcs of said second pair of arcs are constituted by outer edges of oppositely extending tabs formed as parts of said resilient panel.

3. A cleaning implement for a firearm, the cleaning implement comprising:

a rigid support extending along an axis and having front and rear ends;

a plurality of axially spaced elastomeric panels secured to said rigid support, each of said elastomeric panels being resilient and flexible, having a rigidity less than that of said rigid support, extending radially outward from said rigid support, and having a front surface and a rear surface facing in opposite directions along said axis, and each said panel also having an outer edge extending from its front surface to its rear surface;

means at said rear end of the rigid support for securing said implement to an elongated manipulating element, and means for securing a cleaning patch to the cleaning implement, whereby said cleaning patch can be maintained in contact with the outer edge of each of said elastomeric panels while the implement is moved into a passage in a firearm;

wherein the axially spaced elastomeric panels are connected by a hub surrounding said rigid support, and said hub and said panels are composed of the same elastomeric material and molded as a unit.

4. A cleaning implement for a firearm, the cleaning implement comprising:

a rigid support extending along an axis and having front and rear ends;

a plurality of axially spaced elastomeric panels secured to said rigid support, each of said elastomeric panels being resilient and flexible, having a rigidity less than that of said rigid support, extending radially outward from said rigid support, and having a front surface and a rear surface facing in opposite directions along said axis, and each said panel also having an outer edge extending from its front surface to its rear surface; means at said rear end of the rigid support for securing said implement to an elongated manipulating element, and means for securing a cleaning patch to the cleaning implement, whereby said cleaning patch can be maintained in contact with the outer edge of each of said elastomeric panels while the implement is moved into a passage in a firearm; wherein each said panel is in the shape of a symmetrical cross in axial projection.

* * * * *